US006364782B1

(12) United States Patent
Ochi

(10) Patent No.: US 6,364,782 B1
(45) Date of Patent: Apr. 2, 2002

(54) AMUSEMENT SYSTEM

(75) Inventor: Yasushi Ochi, Osaka (JP)

(73) Assignee: Oriental Sangyo, Ltd., Osaka (JP)

( * ) Notice: Subject to any disclaimer, the term of this patent is extended or adjusted under 35 U.S.C. 154(b) by 0 days.

(21) Appl. No.: 09/417,919

(22) Filed: Oct. 13, 1999

(30) Foreign Application Priority Data

Oct. 14, 1998 (JP) ..... 10-291774

(51) Int. Cl.[7] ..... A63G 31/00
(52) U.S. Cl. ..... 472/134; 472/135; 482/27
(58) Field of Search ..... 472/128, 134, 472/135; 482/23, 27; 5/665, 678, 681

(56) References Cited

U.S. PATENT DOCUMENTS

| | | | | | |
|---|---|---|---|---|---|
| 3,130,816 | A | * | 4/1964 | Wright | 482/23 |
| 4,491,993 | A | * | 1/1985 | Santo | 5/681 |
| 4,513,463 | A | * | 4/1985 | Santo | 5/681 |
| 4,637,082 | A | * | 1/1987 | Moore et al. | 5/681 |
| 4,941,223 | A | * | 7/1990 | Santo | 5/681 |
| 5,535,463 | A | * | 7/1996 | Chiu | 5/665 |
| 5,575,738 | A | * | 11/1996 | Millington et al. | 482/35 |

FOREIGN PATENT DOCUMENTS

| | | |
|---|---|---|
| JP | 55-45317 | 3/1980 |
| JP | 3-21249 | 3/1991 |

* cited by examiner

*Primary Examiner*—Kien T. Nguyen
(74) *Attorney, Agent, or Firm*—Armstrong, Westerman & Hattori, LLP

(57) ABSTRACT

An amusement system for infants is provided which gives a player a special bodily sensation that cannot be experienced in daily life. The amusement system comprises: a main body (10) including a mattress (11) of a generally flat rectangular solid shape housed in a frame (13), and pressing means (17) for externally pressing the mattress (11); and an enclosure (20) surrounding the frame (13). The mattress (11) comprises a bag (12) formed of a transparent flexible urethane sheet, and a liquid component including differently colored water and oil filled in the bag (12). The pressing means (17) includes a driver (18) incorporating a hydraulic cylinder, and a press plate (19) connected to a piston rod of the hydraulic cylinder. The press plate (19) is pivoted by the operation of the hydraulic cylinder to press a side face of the mattress (11) from the outside toward the inside, whereby the upper surface of the mattress (11) is waved.

8 Claims, 8 Drawing Sheets

AMUSEMENT SYSTEM

BACKGROUND OF THE INVENTION

1. Field of the Invention

The present invention relates to an amusement system which is mainly intended for infants and to be installed in an amusement section in an amusement park, a department store or a supermarket.

2. Description of Related Art

As well known, various amusement systems are installed in amusement parks and the like. For example, there are known amusement systems which comprise a horizontal rotary shaft, arms fixed to the shaft and a seat fixed to the arms, whereby the seat is rotated or pivoted about the rotary shaft within a vertical plane. With these systems, a player on the seat bodily senses the gravity during ascent and the zero gravity during descent. That is, the player can easily get a special bodily sensation that cannot be experienced in daily life. These amusement systems have gained great popularity among adolescents.

Roller coasters are also well known as amusement rides which cause riders to feel speeds and thrills. In recent years, amusement rides of an improved type have been proposed which are provided with a loop portion and a sudden reverse portion for enhancement of the feeling of speeds and thrills. These amusement systems which also give riders a special bodily sensation that cannot be experienced in daily life, have gained great popularity among adolescents.

However, the aforesaid amusement systems have been developed for adolescents who have a sufficient physical strength, and a limited number of amusement systems have been developed for infants.

It is therefore an object of the present invention to provide an amusement system for infants which gives infant players a special bodily sensation that cannot be experienced in daily life.

SUMMARY OF THE INVENTION

In accordance with one aspect of the present invention to achieve the aforesaid object, there is provided an amusement system, which comprises a mattress provided on a floor in a playing space to allow a player to play thereon, the mattress comprising a bag of a flexible sheet and fluid liquid filled in the bag. The bag of the mattress is not necessarily required to be fully filled with the fluid liquid, but some gas may be present therein. Needless to say, the bag needs to be gas-tight for prevention of leakage of the liquid filled therein. The flexible sheet which; forms the bag may be stretchable.

In the amusement system having the aforesaid construction, the player walks around on the mattress constituted by the bag of the flexible sheet filled with the fluid liquid and, at this time, a portion of the mattress on which the player touches down is substantially depressed and the other portion of the mattress is substantially raised. Therefore, the player can get a walking feeling different from that obtained when the player walks on the ground.

When a plurality of players simultaneously walk around on the mattress, the upper surface of the mattress is waved in an unexpected way. Therefore, some players are raised on the mattress by the waving motion of the mattress caused by the other players, thereby feeling as if they were surfing. Thus, the players can get a surfing feeling that cannot normally be experienced, without wetting their bodies.

In the amusement system, at least a top flexible sheet portion of the bag of the mattress may be transparent. Where some air is present in the bag or floatable ornamental objects are present in the liquid, the player can see the air (air bubbles) or the ornamental objects moving around in the bag as the player moves around on the mattress. Therefore, the amusement system can provide visual amusement in addition to the aforesaid special walking feeling and surfing feeling. Further, the liquid filled in the bag may include a plurality of types of liquids which are immiscible with each other and different in specific gravity. With this arrangement, the player can see the interfaces between the liquids intricately moving as the player moves around on the mattress. Thus, the amusement system provides an additional visually amusing effect. In this case, the plurality of types of liquids preferably have different colors. With this arrangement, the player can see distinct interfaces between the liquids. Thus, the amusement system further provides an aesthetic effect.

In the amusement system, the bag of the mattress may be partitioned into a plurality of cells as viewed in plan, and the liquid may be filled in the respective cells. With this arrangement, even if the plurality of players are localized in one portion of the mattress, a moderate waving motion of the mattress can be ensured without extreme depression in that portion and extreme inflation in the other portion. However, if the bag is partitioned into too many cells, the upper surface of the mattress is less liable to be waved. Therefore, the number of cells in the bag should properly be determined so that the moderate waving motion of the mattress can be ensured, and the volume of the liquid to be filled in each cell in the bag should be smaller than the volume of the cell. Further, at least an adjacent pair of the cells may contain differently colored liquids. Thus, an additional aesthetic effect and visually amusing effect can be provided by color combination.

The amusement system may further comprise a frame which surrounds the mattress. With this arrangement, the strength and shape retainability of the entire mattress can be improved. However, the frame is not necessarily required to be provided separately from the mattress, but may be integrally attached to the side faces of the mattress.

In accordance with another aspect of the present invention, there is provided an amusement system, which comprises: an annular frame portion comprised of an air-filled tubular bag of a synthetic resin sheet; and a mattress portion having upper and lower portions of a flexible sheet, and an inner space defined by the upper and lower portions and an inner circumference of the annular frame portion and filled with fluid liquid, whereby a player can play on the mattress portion.

At least one of the upper and lower portions of the mattress portion may be comprised of a plurality of annular air-filled tubular bags concentrically connected to one another. Further, the frame portion may be comprised of a plurality of annular air-filled tubular bags vertically connected to one another as projecting upward above the upper portion of the mattress portion.

The amusement systems may further comprise pressing means for applying an external force to the liquid. The pressing means is manually or automatically operated to partially press the liquid, so that the upper surface of the mattress can readily be waved. With this arrangement, even if only one player is present on the mattress, the player can get the surfing feeling. The pressing means is not necessarily required, because an equivalent waving effect can be provided when a person outside the amusement system directly presses the upper surface of the mattress by hands.

DETAILED DESCRIPTION OF PREFERRED EMBODIMENTS

Figure 1:
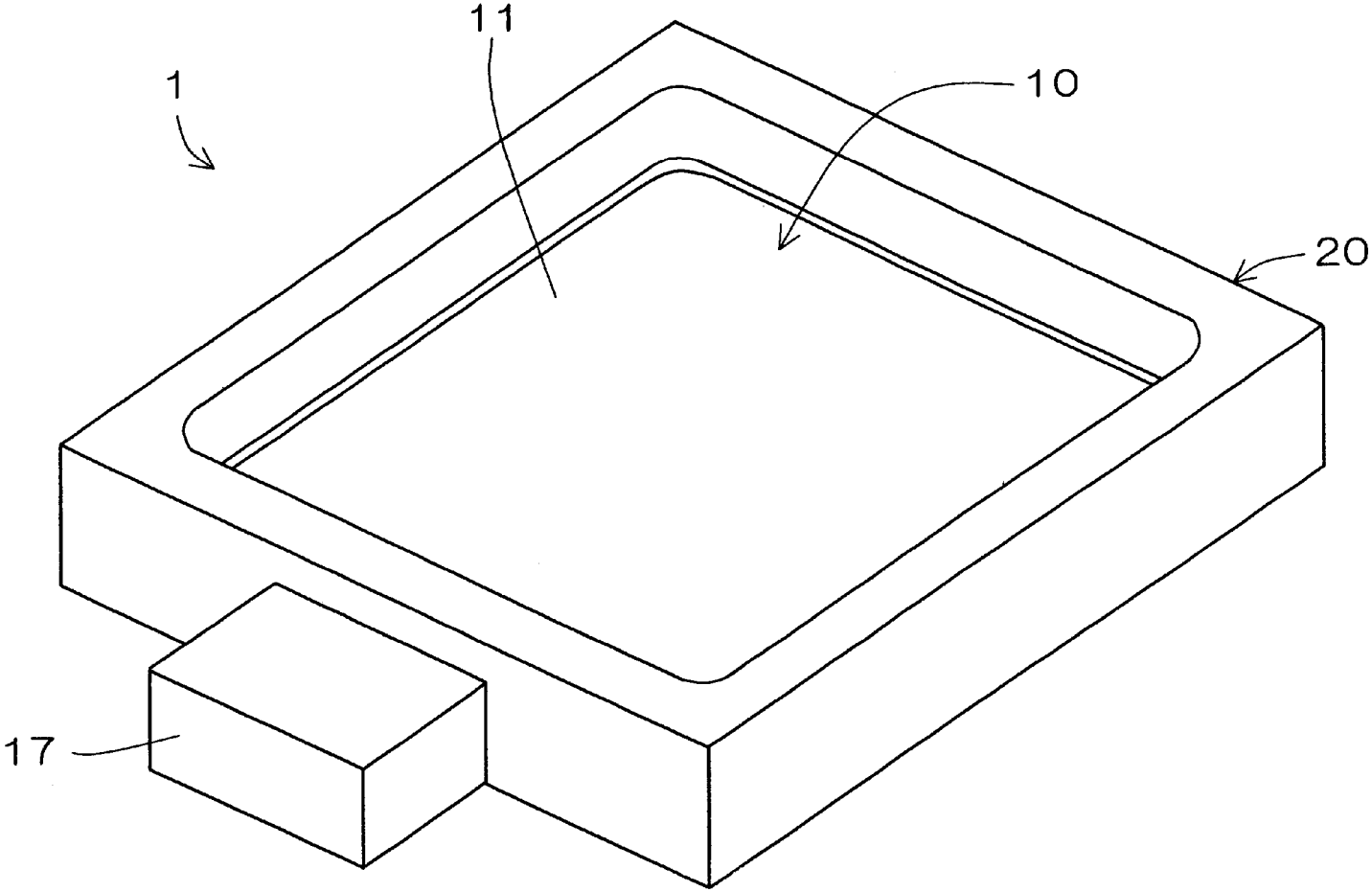
FIG. 1 is a perspective view illustrating an amusement system according to one embodiment of the present invention.
Figure 2:
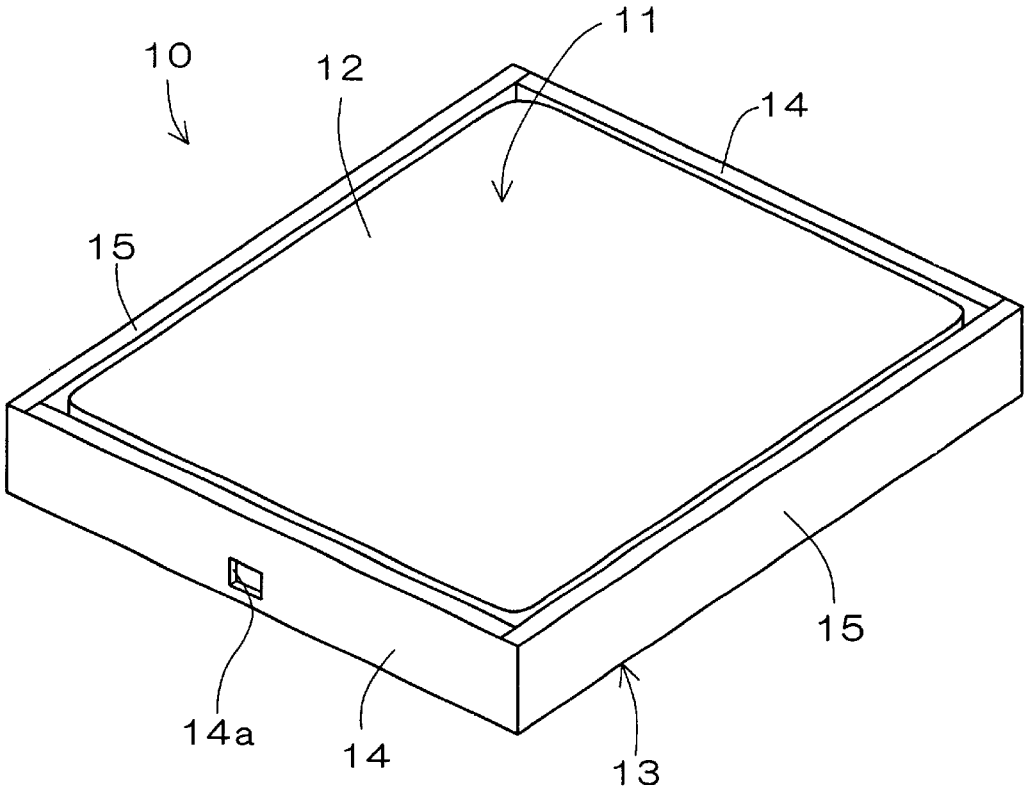
FIG. 2 is a perspective view illustrating a mattress and a frame of the amusement system.
Figure 3:
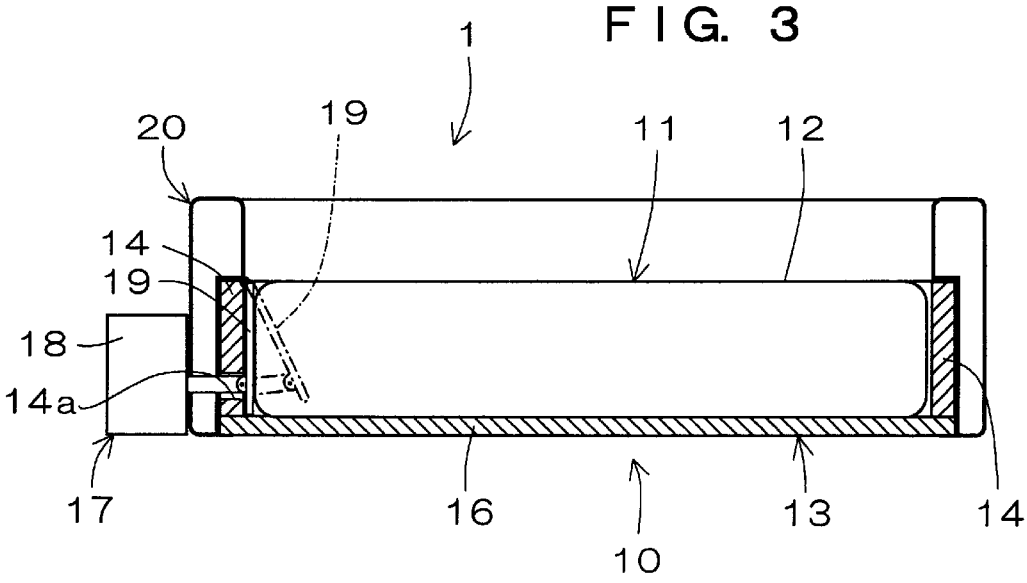
FIG. 3 is a sectional view illustrating the amusement system.

Embodiments of the present invention will hereinafter be described with reference to the drawings. As shown in FIGS. 1 to 3, an amusement system 1 comprises: a main body 10 including a mattress 11 of a generally flat rectangular solid shape, a frame 13 of an open top tray-like shape which houses the mattress 11, and pressing means 17 for externally pressing the mattress 11; and an enclosure 20 surrounding the frame 13 of the main body 10.

Figure 4A:
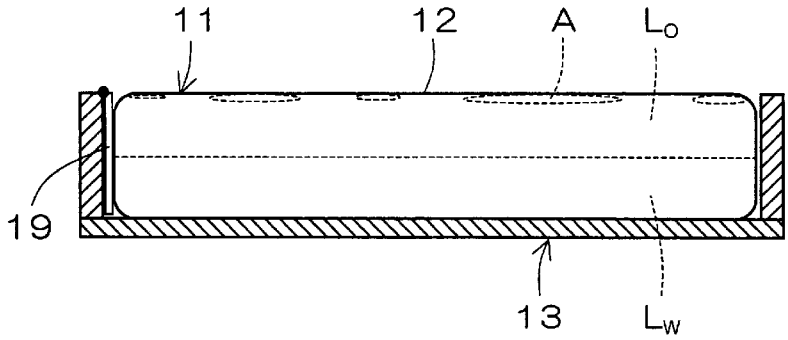
FIGS. 4A to 4C are schematic sectional views illustrating the amusement system in use.

The mattress 11 comprises a bag 12 formed of a transparent urethane sheet as a flexible sheet, and a liquid component including substantially the same amounts of differently colored water Lw and oil Lo filled in the bag 12 as shown in FIG. 4A. Some air A is present as air bubbles scattered on a layer of the oil in the bag 12.

As shown in FIGS. 2 and 3, the frame 13 includes four transparent acryl side plates 14, 15 surrounding the mattress 11 of the generally flat rectangular solid shape, and a transparent acryl bottom plate 16 on which the mattress 11 is placed. One of the side plates 14 has an opening 14*a* formed in the center thereof.

The pressing means 17 is provided adjacent the one side wall 14 formed with the opening 14*a,* and includes a driver 18 incorporating a hydraulic cylinder not shown, and a press plate 19 connected to a distal end of a piston rod of the hydraulic cylinder extending through the opening 14*a.* The press plate 19 is held between the one side plate 14 of the frame 13 and the mattress 11. An upper edge of the press plate 19 is supported pivotally about an upper edge of the side plate 14, so that the press plate 19 is pivoted inwardly of the frame 13 by the operation of the hydraulic cylinder, as indicated by a one-dot-and-dash line in FIG. 3, to press a side face of the mattress 11 housed in the frame 13 from the outside toward the inside. The driver 18 is controlled by control means not shown so as to actuate the hydraulic cylinder at predetermined time intervals.

As shown in FIGS. 1 and 3, the enclosure 20 is a looped bag formed of a synthetic resin sheet such as a vinyl sheet and filled with air for shape retention and cushioning, and is fitted around the frame 13. The enclosure 20 extends upward to a certain height above the upper edge of the frame 13, and the upper portion of the enclosure 20 projects inwardly of the frame 13 to cover the upper edge face of the rigid frame 13. Therefore, a player is prevented from being brought into direct contact with the frame 13 when the player inadvertently stumbles on the mattress 11.

Figure 4B:
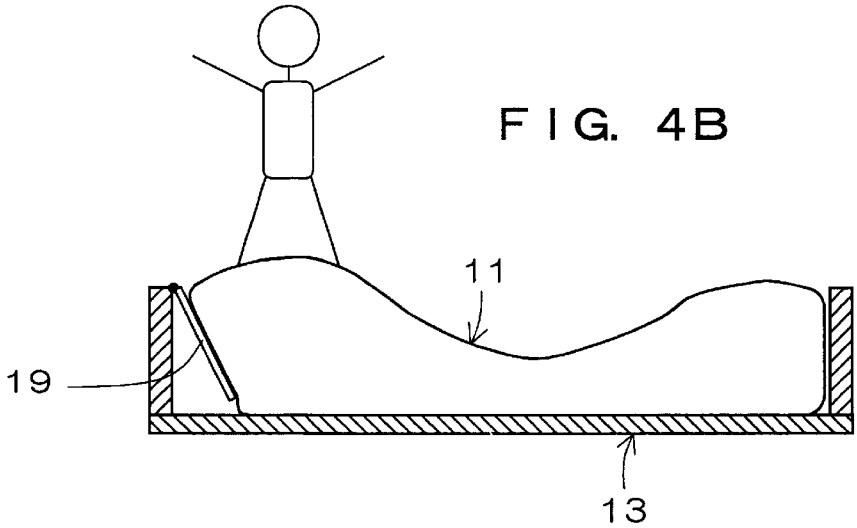
Figure 4C:
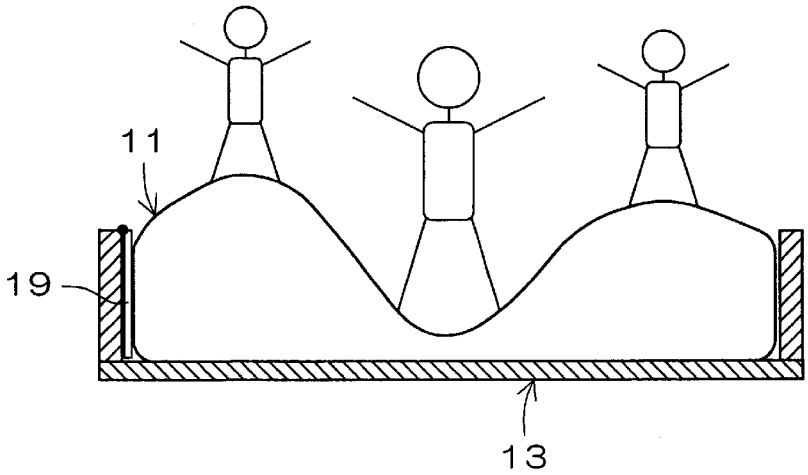

In the amusement system 1 having the aforesaid construction, the press plate 19 in contact with an interior surface of the frame 13 as shown in FIG. 4A is pivoted to press the side face of the mattress 11 provided in the frame 13 as shown in FIG. 4B, whereby the upper surface of the mattress 11 is waved to raise and sink the player on the mattress 11. Thus, the player can get a feeling as if he was surfing.

Where a plurality of players play on the mattress 11, portions of the mattress on which the players touch down are depressed and the other portion is raised as shown in FIG. 4C even if the hydraulic cylinder of the pressing means 17 is not operative. Therefore, the waving motion on the upper surface of the mattress 11 is intricately changed by the plurality of players moving around on the mattress 11, so that the amusement of the surfing feeling can be enhanced.

When the upper surface of the mattress 11 is waved by the pressing operation by means of the press plate 19 and by the movement of the players, the two types of liquids, i.e., the differently colored water Lw and oil Lo, are intricately moved in the bag 12, and are commingled with each other to exhibit color variations and an intricate movement in the interface therebetween. Further, the air bubbles A present in the bag 12 move around beneath the upper surface of the mattress 11. Since the bag 12 of the mattress 11 is formed of the transparent urethane sheet, the players playing on the mattress 11 can clearly see the behavior of the interface, the color variations and the movement of the air bubbles. Thus, the players can get the visual amusement as well as the aforesaid surfing feeling.

Figure 5:
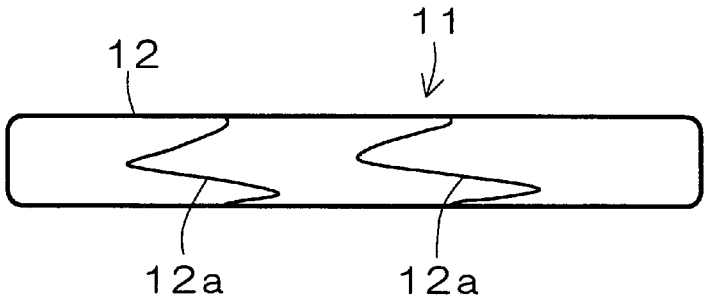
FIG. 5 is a vertical sectional view illustrating a mattress of an amusement system according to another embodiment of the invention.
Figure 6:
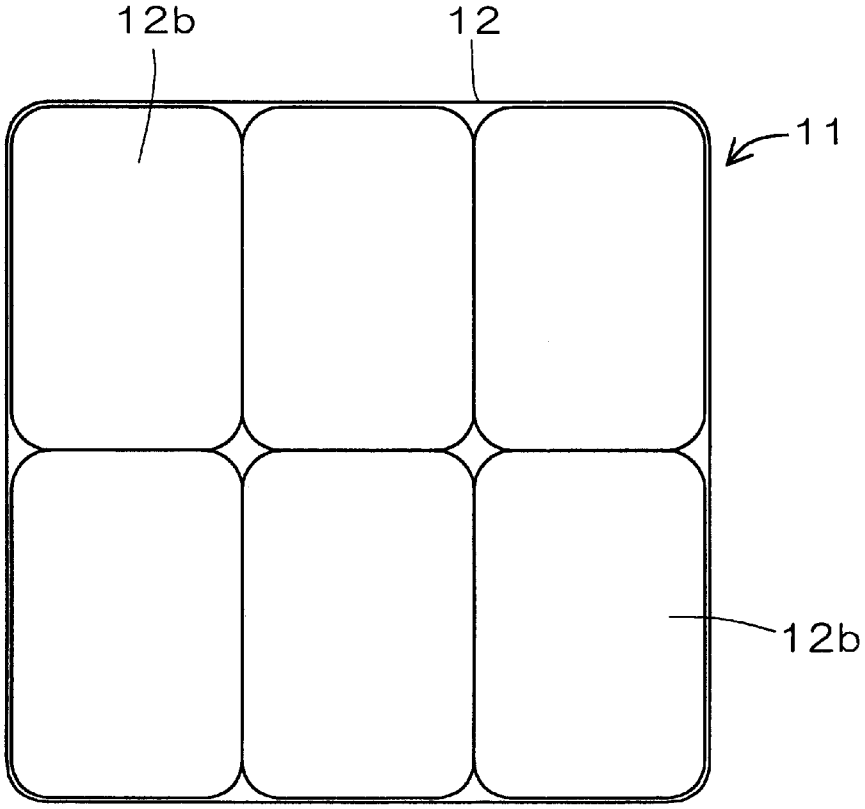
FIG. 6 is a horizontal sectional view illustrating a mattress of an amusement system according to further another embodiment of the invention.

FIGS. 5 and 6 illustrate other embodiments of the present invention. Although the bag 12 of the mattress 11 is not partitioned in the aforesaid embodiment, mattresses 11 shown in FIGS. 5 and 6 are different from the aforesaid embodiment in that the bag 12 is partitioned into a plurality of cells. The other components of amusement systems according to these embodiments are the same as those according to the aforesaid embodiment and, therefore, no explanation will be given thereto. The mattresses 11 which have such different constructions will hereinafter be described.

In the mattress 11 shown in FIG. 5, the bag 12 is partitioned into three cells by two diaphragms 12*a* fusion-bonded onto the interior surface of the bag 12, and differently colored liquids are filled in the respective cells. Where the bag 12 is partitioned simply by the diaphragms, however, it is difficult to transfer the pressure caused by partially pressing the mattress 11 by means of the press plate 19 to an adjacent cell, so that the waving motion on the upper surface of the mattress 11 may be mitigated. Therefore, the two diaphragms 12*a* are slacked in central portions thereof.

In the mattress 11 shown in FIG. 6, a plurality of small bags 12*b* each formed of a transparent urethane sheet are provided in the bag 12 to form six cells in the bag 12, and differently colored liquids are filled in the respective small bags 12*b.* In this case, the urethane sheet forming the small bags 12*b* has a smaller thickness and a greater flexibility than the urethane sheet forming the outer bag 12, and the volume of the colored liquid filled in each small bag 12*b* is smaller than the volume of the small bag 12 in order to cause a sufficient waving motion in the entire mattress 11.

In the amusement system having either of the mattresses 11 having the aforesaid constructions, the upper surface of the mattress 11 is waved by pressing the side face of the mattress 11 by means of the press plate 19 or by the player moving around on the mattress 11, so that the player can get the surfing feeling. In addition, the player can get visual amusement because the various colors of the liquids filled in the respective cells can simultaneously be seen through the transparent urethane sheet of the mattress 11.

Figure 7A:
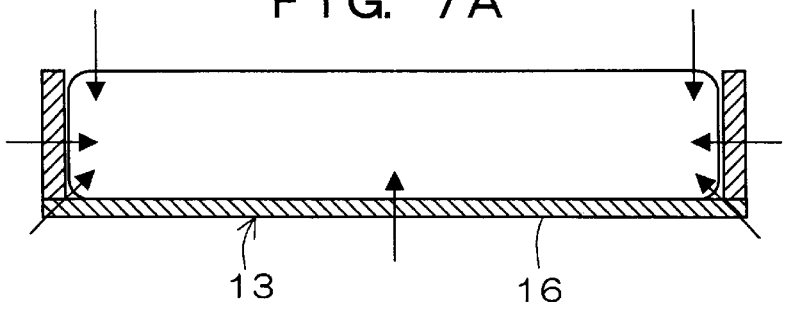
FIGS. 7A to 7D are schematic sectional views illustrating modifications of pressing means of the amusement system.

Although the amusement systems according to the aforesaid embodiments are each constructed such that the side face of the mattress 11 is pressed from one side thereof, the method of pressing the mattress 11 is not limited thereto. For example, as shown in FIG. 7A, the mattress 11 may be pressed upward from the bottom face thereof. Alternatively, a lower corner portion of the mattress 11 may be pressed upward, or an upper peripheral portion of the mattress 11 may be pressed downward. Where the mattress 11 is laterally pressed, the mattress 11 may be pressed not only from one side thereof, but also from laterally opposite sides thereof simultaneously or alternately in a time staggered manner.

Figure 7B:
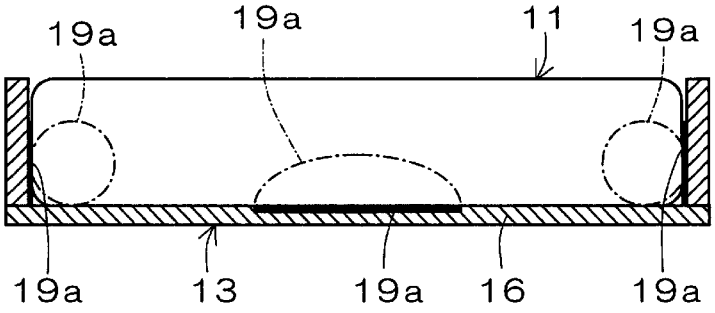
Figure 7C:
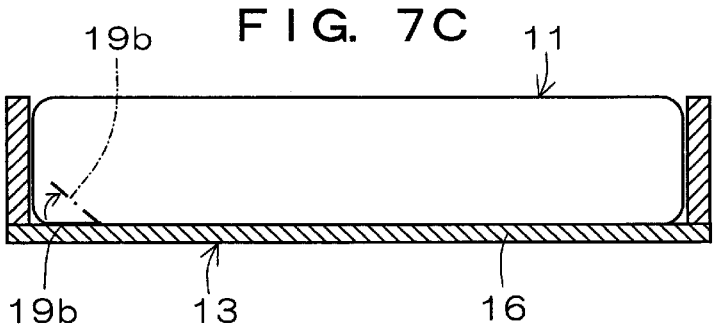
Figure 7D:
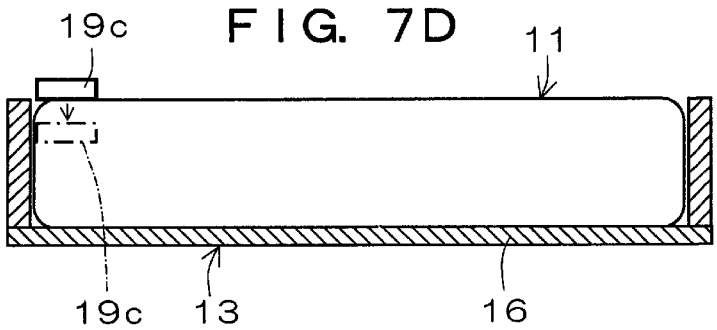

More specifically, as shown in FIG. 7B, balloon-like bags 19*a* of an elastic material may be provided between the mattress 11 and the side plates 14, 15 of the frame 13 and between the mattress 11 and the bottom plate 16 of the frame 13, so that the pressing of the mattress 11 is achieved by supplying air into the bags 19*a* by air feeding means such as a compressor to inflate the bags 19*a*. As shown in FIG. 7C, a plate 19*b* may be attached to the bottom plate 16, so that the pressing of the mattress 11 is achieved by pivoting the plate 19*b* upward by means of a hydraulic cylinder or the like. As shown in FIG. 7D, a press plate 19*c* may be provided on an upper peripheral surface of the mattress 11, so that the pressing of the mattress 11 is achieved by depressing the press plate 19*c* by means of a hydraulic cylinder or the like. It is preferred that a portion of the mattress 11 other than the upper surface, e.g., the side face or the bottom face of the mattress 11, is pressed, because the player plays on the upper surface of the mattress 11.

The mattress 11 is automatically pressed by the pressing means in the aforesaid embodiments, but may manually be pressed. The pressing means is not necessarily required, because the upper surface of the mattress 11 can be waved by directly pressing the upper surface of the mattress 11 with hands by a person other than the player.

Further, the bag 12 of the mattress 11 is not necessarily required to be formed of a transparent material but, as described above, the use of the transparent material makes it possible to give the visual amusement to the player. The mattress 11 does not necessarily have a generally square plan shape as shown in FIGS. 1 and 2, but may have rectangular, circular, oval or any other plan shape.

Where the bag 12 of the mattress 11 is formed of a transparent material, it is sufficient if at least the top portion of the mattress 11 is transparent. If the side and bottom portions of the mattress 11 are also formed of a transparent material or material pervious to light, the aesthetic effect can be enhanced by lighting the mattress 11 from the lateral and under sides thereof.

In the aforesaid embodiments, liquids such as water and oil are filled in the bag 12 of the mattress 11. Where the top portion of the mattress 11 is transparent, the visually amusing effect can be enhanced not only by coloring the liquids but also by putting floatable ornamental objects such as balls, colored cellophane pieces and colored particles in the liquids filled in the bag 12.

Where the bag 12 of the mattress 11 is partitioned into the plurality of cells as shown in FIGS. 5 and 6, the presence of the diaphragms 12*a* or the small bags 12*b* prevents the upper surface of the mattress 11 from extremely sinking even if the plurality of players are localized in one portion of the upper surface of the mattress 11. Thus, the moderate waving motion can be ensured.

Although a single color liquid is filled in each of the cells defined by the diaphragms 12*a* or the small bags 12*b* in the mattress 11 shown in FIG. 5 or 6, plural types of liquids, e.g., water and oil, which are immiscible with each other and different in specific gravity may be filled in each of the cells as in the first embodiment.

In the aforesaid embodiments, the frame 13 surrounding the mattress 11 is formed of the acryl plates, but the construction of the frame 13 is not limited thereto. For example, the frame 13 may be formed by connecting opposite ends of an elongated web such as of a non-stretchable thick fabric, a vinyl chloride sheet or a net to form a loop, in which the mattress 11 is fitted. In this case, upper and lower edge portions of the web constituting the frame are folded outward or inward, so that the upper and lower edges of the web frame are rounded. Thus, the strength of the web frame is enhanced and the mattress 11 is less liable to be damaged in contact with the frame when the upper surface of the mattress 11 is waved. This arrangement improves the safety of the players, and provides various effects. Further, the strength of the frame can be enhanced by fitting reinforcement wires along the upper and lower edges of the web, and folding the upper and lower edge portions along the wires.

Figure 8A:
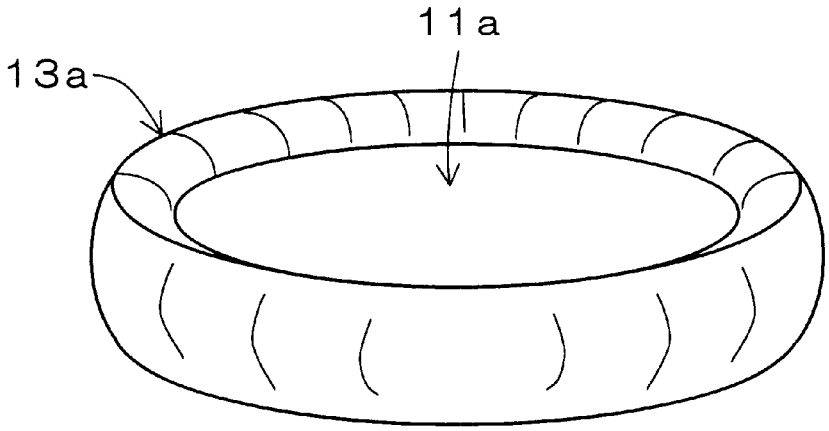
FIGS. 8A and 8B are a perspective view and a schematic sectional view, respectively, illustrating an amusement system according to still another embodiment of the invention.
Figure 8B:
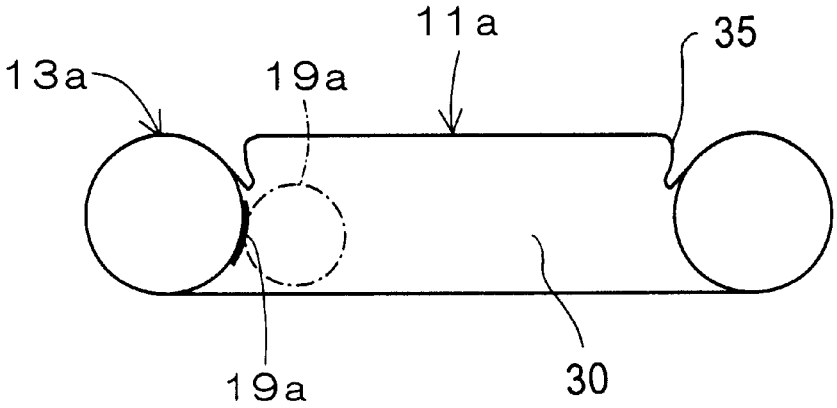

The frame and the mattress are not necessarily separate members as in the aforesaid embodiments. For example, a mattress portion 11*a* may be formed integrally with a frame portion 13*a* in such a manner that the frame portion 13*a* is produced by filling an annular tubular bag of a synthetic resin sheet with air and top and bottom openings of the frame portion 13*a* are closed with flexible sheets such as of urethane, as shown in FIGS. 8A and 8B. In this case, it is important to fill a smaller volume of liquid 30 into the mattress portion 11*a* and to provide some slack 35 between the frame portion 13*a* and the flexible sheet closing the top opening of the frame portion 13*a* in order to cause the moderate waving motion on the upper surface of the mattress portion 11*a*.

Further, a balloon-like bag 19*a* of an elastic material may be provided in the mattress portion 11*a*. With this arrangement, the liquid filled in the mattress portion 11*a* can be pressed by supplying air into the bag 19*a* by air feeding means such as a compressor to inflate the bag 19*a*. Thus, the upper surface of the mattress portion hla can be waved.

Figure 9A:
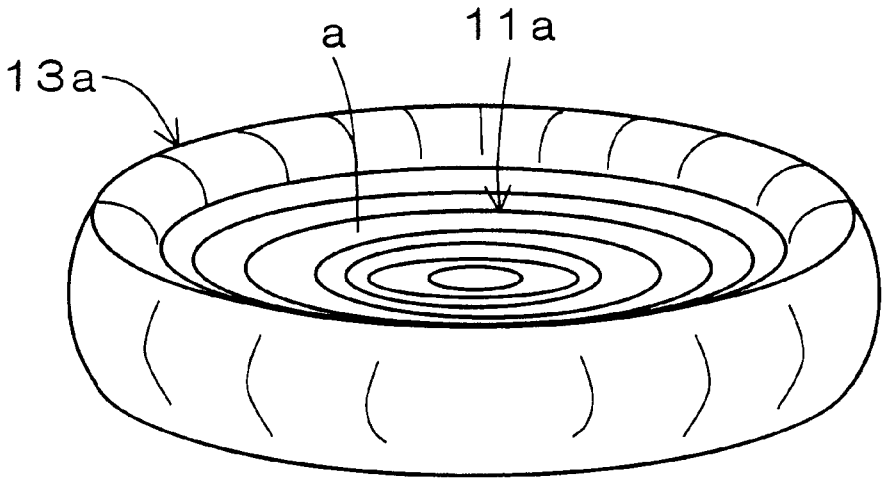
FIGS. 9A and 9B are a perspective view and a schematic sectional view, respectively, illustrating an amusement system according to further another embodiment of the invention.
Figure 9B:
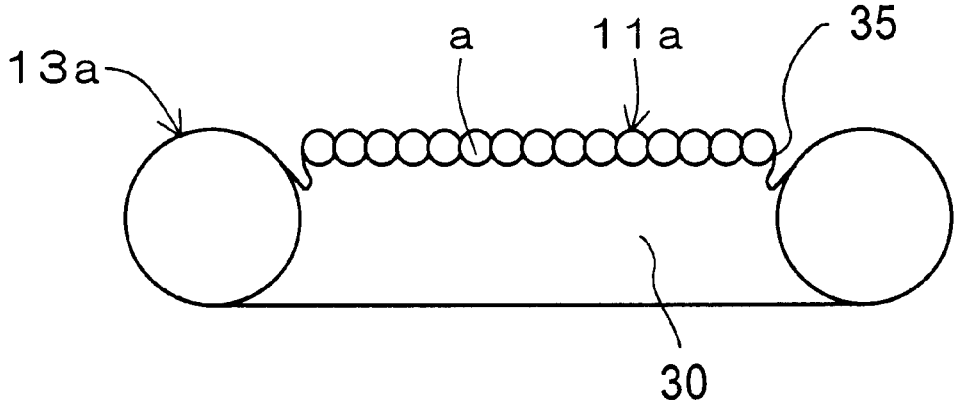

As shown in FIGS. 9A and 9B, an air mat a obtained by connecting a plurality of air-filled tubular bags may be employed instead of the urethane sheet to form the top surface of the mattress portion 11*a*. This improves the strength of the mattress portion 11*a* and the players' footing stability.

Figure 10A:
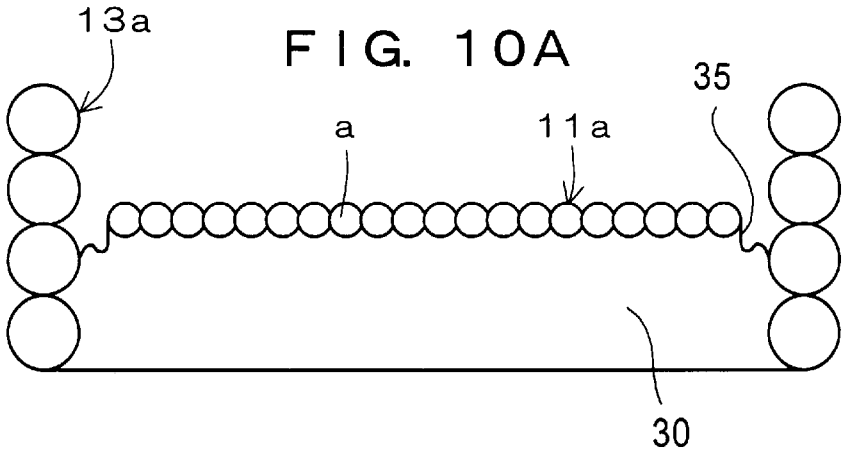
FIGS. 10A to 10C are schematic sectional views illustrating modifications of the amusement systems shown in FIGS. 8A, 8B, 9A and 9B.
Figure 10B:
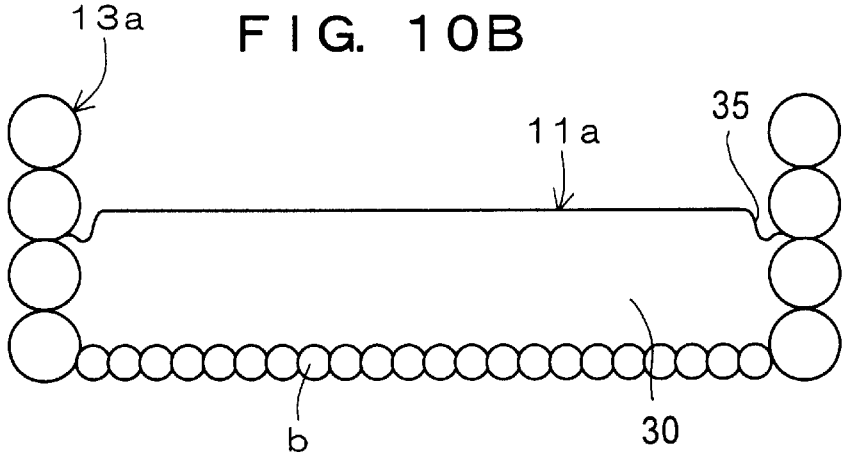
Figure 10C:
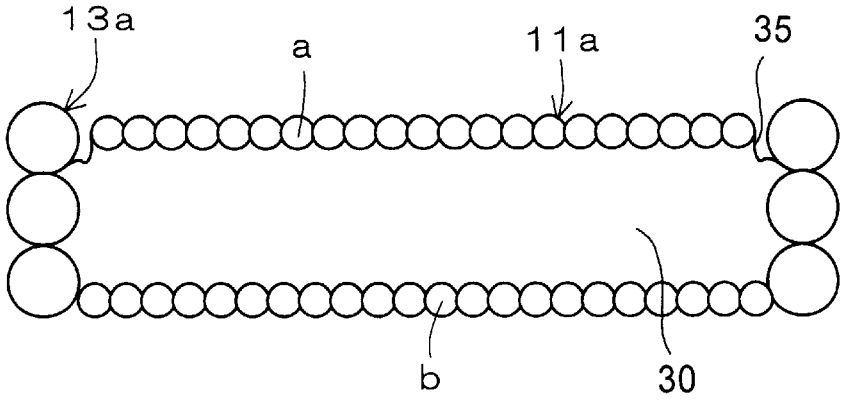

As shown in FIGS. 10A, 10B and 10C, the frame portion 13*a* may be formed by vertically connecting a plurality of annular air-filled tubular bags. Further, as shown in FIGS. 10A and 10B, the mattress portion 11*a* may be integrated with the frame portion 13*a* in such a state that the mattress portion hla sinks within the frame portion 13*a*. In this case, the frame portion 13*a* per se has the same function as the enclosure 20, obviating the need for the provision of the enclosure 20.

As shown in FIGS. 10B and 10C, an air mat b obtained by connecting a plurality of air-filled tubular bags may be employed instead of the urethane sheet to form the bottom surface of the mattress portion 11*a*. This imparts the mattress portion 11*a* with a cushioning property.

Further, the shape retainability of the entire mattress 11 may be enhanced by forming the side walls of the mattress 11 from a reinforced rubber or a plastics material. In this case, the frame is not necessarily required.

Although the frame 13 has the bottom plate 16 on which the mattress 11 is placed in the aforesaid embodiments, the bottom plate 16 is not necessarily required. The mattress 11 may be placed directly on a floor. A cushioning material having a substantial thickness may be provided on the bottom plate 16 or the floor, on which the mattress 11 is placed. With this arrangement, the players are less susceptible to shocks thanks to the presence of the cushioning material even if the upper surface of the mattress 11 is depressed to a greater extent.

Although the bag 12 of the mattress 11 filled with the liquids is sealed in the aforesaid embodiments, a pipe may be connected to the bag 12 as projecting upward to a certain height so that the inside of the bag 12 is open to the atmosphere. When the mattress 11 is pressed by the pressing means 17 or the like, a certain volume of the liquids pushed aside by the pressing of the mattress is expelled from the bag 12 into the pipe to cause the waving motion on the upper surface of the mattress 11.

Further, heating means such as an electric heater is preferably provided on the bottom face or side face of the mattress 11 so that the entire mattress 11 can be heated to be maintained at a moderate temperature, because the temperature of the mattress 11 may be reduced in winter.

Although the mattress 11 housed in the frame 13 is enclosed simply by the enclosure 20 in the aforesaid embodiments, the entire system is preferably surrounded with a net or the like to prevent the players from jumping out of the mattress 11.

What is claimed is:

1. An amusement system, comprising:

an annular frame portion, said annular frame portion comprising:

a tubular bag made of a flexible sheet;

a mattress portion, said mattress portion comprising:

an upper portion and a lower portion, each connected to an inner circumference of the annular frame portion to define an inner space of the mattress portion, and an inflatable bag provided in the inner space of the mattress portion.

2. The amusement system of claim 1, further comprising:

a compressor connected to the inflatable bag, for inflating the bag within the inner space.

3. The amusement system of claim 1, further comprising:

a fluid filling the inner space of the mattress portion around said inflatable bag.

4. An amusement system, comprising:

an annular frame portion, said annular frame portion comprising:

a tubular bag made of a flexible sheet;

a mattress portion, said mattress portion comprising:

an upper portion and a lower portion, each made of a flexible sheet, and each connected to an inner circumference of the annular frame portion to define an inner space of the mattress portion; and said upper portion having slack where connected to the annular frame portion.

5. The amusement system of claim 4, further comprising:

a fluid filling the inner space of the mattress portion.

6. The amusement system of claim 4, further comprising:

an inflatable bag provided in the inner space of the mattress portion.

7. The amusement system of claim 6 further comprising:

a compressor connected to the inflatable bag, for inflating the bag within the inner space.

8. The amusement system of claim 7, further comprising:

a fluid filling the inner space of the mattress portion around said inflatable bag.

* * * * *